United States Patent [19]

Scarbrough, Jr.

[11] Patent Number: 4,615,366

[45] Date of Patent: Oct. 7, 1986

[54] LOG SPLITTER WITH RAPID RETURN HYDRAULIC CYLINDER

[76] Inventor: John D. Scarbrough, Jr., 234-52 First Street, Piqua, Ohio 45356

[21] Appl. No.: 752,554

[22] Filed: Jul. 8, 1985

[51] Int. Cl.[4] ..... B27L 7/00

[52] U.S. Cl. ..... 144/193 A; 91/410

[58] Field of Search ..... 144/193 R, 193 A; 91/400, 404, 410

[56] References Cited

U.S. PATENT DOCUMENTS 3,077,214 2/1963 Brukner ..... 144/193 A

FOREIGN PATENT DOCUMENTS 190103 11/1982 Japan ..... 91/410

*Primary Examiner*—Francis S. Husar

*Assistant Examiner*—Jorji M. Griffin

*Attorney, Agent, or Firm*—Jacox & Meckstroth

[57] ABSTRACT

A wheel supported mobile log splitter has an elongated frame supporting a stationary wedge-shaped log splitting element and an opposing movable ram which is connected to the piston rod of a hydraulic cylinder mounted on the frame. The cylinder is supplied with high pressure hydraulic fluid by an engine driven pump which receives fluid from a hydraulic reservoir associated with the frame and is also connected to the reservoir by a line having a high pressure relief valve. Hydraulic fluid is exhausted from the cylinder and returned to the reservoir through a pair of control valves which are coupled together and actuated simultaneously to provide for rapid return of the ram and for minimizing the cycle time to split a log.

8 Claims, 4 Drawing Figures

LOG SPLITTER WITH RAPID RETURN HYDRAULIC CYLINDER

BACKGROUND OF THE INVENTION

In a mobile log splitter such as, for example, the log splitter disclosed in U.S. Pat. No. 3,077,214 assigned to the assignee of the present invention, an elongated rigid frame has one end portion supporting a wedge-shaped splitting element or wedge, and a hydraulic cylinder is secured to the opposite end portion of the frame. The cylinder has a piston rod which connects with a ram supported by the frame for linear movement in opposing relation to the splitting element or wedge.

A hydraulic fluid storage tank or reservoir is secured to the end portion of the frame which carries the hydraulic cylinder and is supported by an axle which carries a pair of wheels to provide for transporting the log splitter. The reservoir or tank also supports a gasoline engine which drives a hydraulic pump, and the pump supplies hydraulic fluid at a high pressure to the hydraulic cylinder when it is desired to extend the ram for splitting a log.

When a single acting hydraulic cylinder is used on a log splitter to reduce the manufacturing costs, the piston rod and ram are usually returned to the retracted position by a cable connected to a tension spring. The hydraulic supply line extending from the pump to the cylinder is connected to the fluid reservoir through a line having a high pressure relief valve which is selected or set according to the pressure necessary within the hydraulic cylinder to perform the log splitting operation. The hydraulic supply line is also connected to the reservoir by a return line having a control valve which is opened when it is desired to retract the ram so that the fluid in the cylinder returns to the reservoir through the control valve.

It has been found desirable to provide for rapidly returning the ram and the piston rod after splitting a log so that another log may be loaded onto the splitter and split as soon as possible. However, the flow rate of hydraulic fluid from the cylinder back to the reservoir is limited by the size of the control valve which must also be constructed to withstand the high pressure of the fluid pumped into the cylinder during extension of the ram and splitting of a log. If a large control valve is used to provide for a more rapid return for the ram, the cost of the control valve becomes excessive and substantially increases the cost of the log splitter.

SUMMARY OF THE INVENTION

The present invention is directed to a hydraulic log splitter of the general type outlined above and which incorporates an improved and economical control system. The system provides for high pressure hydraulic fluid to be supplied to the hydraulic cylinder from the pump at one flow rate for extending the ram to split a log and for returning the hydraulic fluid from the cylinder to the reservoir at a substantially higher flow rate in order to minimize the cycle time for the splitting operation. In accordance with a preferred form of the invention, the above advantages and features are provided by a control system which includes two relatively small control valves coupled together and connected by separate lines to the hydraulic cylinder and the fluid reservoir. The control valves are normally closed during extension of the ram and splitting of a log, and are opened simultaneously or in unison after the splitting operation when it is desired to retract the ram at a substantially higher speed. The two combined control valves are connected in parallel and are capable of withstanding the substantially high hydraulic pressure required to extend the ram while also providing for a substantially higher flow rate of the hydraulic fluid from the cylinder to the reservoir during retraction of the ram.

Other features and advantages of the invention will be apparent from the following description, the accompanying drawing and the appended claims.

DESCRIPTION OF THE PREFERRED EMBODIMENT

Figure 1:
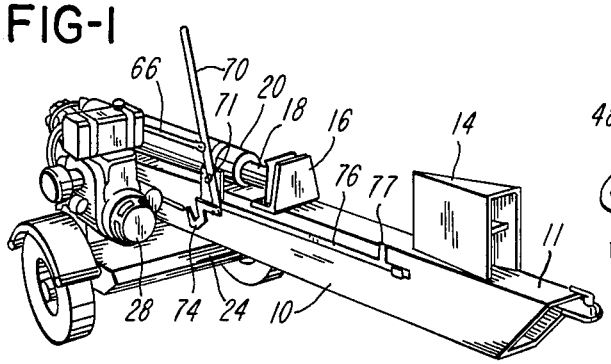
FIG. 1 is a perspective view of a log splitter constructed in accordance with the invention.
Figure 2:
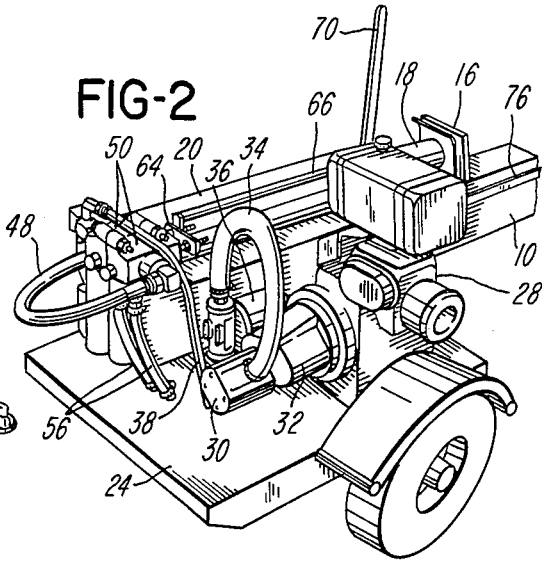
FIG. 2 is a fragmentary perspective view of the log splitter and showing the hydraulic fluid pumping and control system used on the splitter.

The log splitter illustrated in FIGS. 1 and 2 includes an elongated metal frame 10 which has a forward end portion 11 adapted to receive a hitch (not shown) for connecting the log splitter to a towing vehicle. A wedge-shaped log splitting member or wedge 14 is secured to the forward end portion 11 of the frame 10 and opposes a movable log splitting member or ram 16 supported by the frame 10 for sliding linear movement relative to the wedge 14. The ram 16 is connected to the forward end of a piston rod 18 of a hydraulic cylinder 20 secured to the rearward end portion of the frame 10.

The rearward end portion of the frame 10 is secured or welded to the upper wall of a sheet metal tank or reservoir 24 which is adapted to receive a supply of hydraulic fluid or oil. An axle (not shown) extends under the tank or reservoir 24 and supports a pair of wheels to provide for transporting the log splitter behind a towing vehicle. As shown in FIG. 2, the tank or reservoir 24 supports a gasoline driven engine 28 which drives a hydraulic pump 30 through a direct coupled gear reducer 32.

Figure 3:
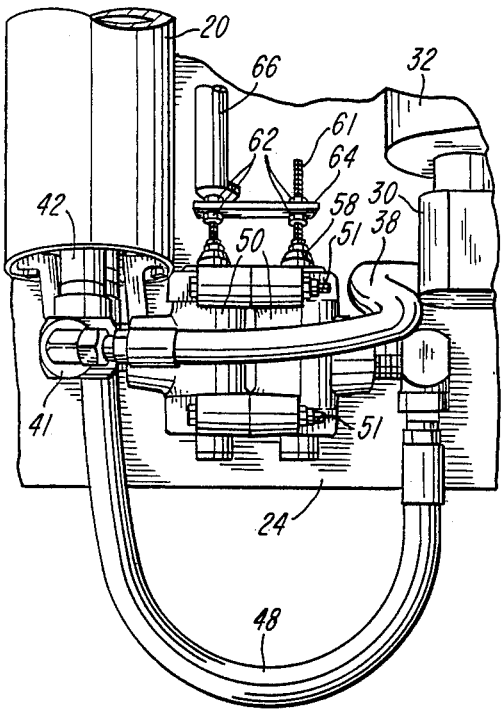
FIG. 3 is an enlarged fragmentary plan view of the control system.
Figure 4:
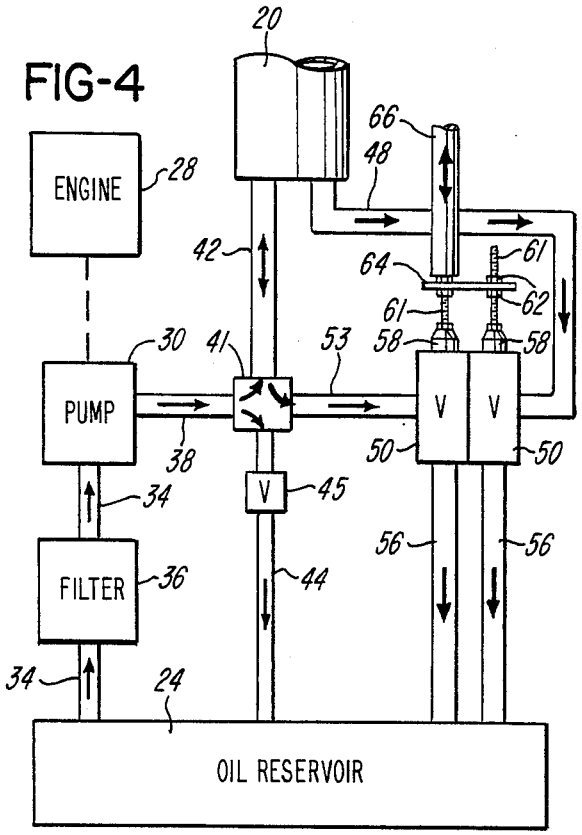
FIG. 4 is a diagramatic illustration of the fluid control system used on the log splitter shown in FIGS. 1–3.

As shown in FIGS. 2 and 4, a line 34 connects the reservoir 24 to the intake of the pump 30 through a fluid or oil filter 36, and the output of the hydraulic pump 30 is connected by a high pressure flexible line 38 to a manifold 41 (FIG. 3) connected to the rearward end of the hydraulic cylinder 20 by a rigid line or fitting 42. The manifold 41 is also connected to the reservoir 24 by a line 44 having a pressure relief valve 45. The valve 45 is adjusted or set to provide the desired hydraulic pressure within the cylinder 20 as required for extending the ram 16 and splitting a log located between the ram 16 and the splitting wedge 14. Preferably, this pressure approaches two thousand p.s.i. in order to provide a ram force of approximately eighteen tons or 36,000 pounds.

After a log is split, the ram 16 and piston rod 18 are returned to their retracted positions by a cable (not shown) which is connected to the bottom of the ram 16 and extends rearwardly under the hydraulic cylinder 20 and around a pulley to a tension spring (not shown) also located under the cylinder 20. As illustrated in FIGS. 3 and 4, the rearward end of the hydraulic cylinder 20 is also connected by a flexible high pressure line 48 to a first high pressure valve 50. This valve 50 is coupled to another or second high pressure valve 50 in back-to-back relation by a set of tie bolts 51. The second valve 50 is connected by a rigid line or fitting 53 to the manifold 41.

A pair of flexible low pressure lines 56 connect the outlets of the valves 50 to the reservoir 24, and each of the valves 50 has a reciprocal or shuttletype valve member 58 which projects forwardly from the body of the valve. A threaded rod 61 extends axially or forwardly from each of the valve members 58 and receives a pair of adjustable nuts 62. A tie plate or bar 64 connects the threaded rods 61 together between the nuts 62 to provide for simultaneous movement or opening and closing of the valves.

A control rod 66 (FIGS. 1 and 3) has a rearward end with a depending ear which connects with the threaded rod 61 projecting from the valve member 58 of one of the valves 50. The control rod 66 extends forwardly parallel with the hydraulic cylinder 20 to a hand actuated lever 70 (FIG. 1) pivotedly supported by a bolt 71 mounted on the forward end portion of the cylinder 20. The lower end portion of the lever 70 is received by a spring actuated latch mechanism 74 which is released in response to slight forward movement of a bar or strap 76 extending adjacent the frame 10. A finger 77 is secured to the forward end of the strap 76 and is engaged by the ram 16 after it is moved to its extended position adjacent the wedge 14.

In operation of the log splitter described above, a log to be split is placed on the frame 10 between the wedge 14 and the ram 16. The upper end of the lever 70 is pushed forwardly to set the latch 74 and close the valves 50 by forward movement of the actuating rod 66 and the connected valve members 58. Hydraulic fluid is pumped into the rear of the cylinder 20 through the lines 38 and 42 at the high pressure determined by the relief valve 45. Any excess high pressure fluid discharged by the pump 30 is returned to the reservoir 24 through the line 44 and the relief valve 45. As the high pressure fluid enters the cylinder 20; the piston rod 18 and ram 16 move forwardly toward the wedge 14 to split the log. When the ram 16 picks up the finger 77 on the strap 76, the latch 74 is released, and the upper end portion of the lever 70 shifts rearwardly to open the valves 50 by moving the rod 66 and valve members 58 rearwardly.

When the valves 50 open, the fluid within the cylinder 20 is discharged or flows outwardly through the lines 42, 48 and 53 to the valves 50 and returns to the reservoir 24 through the lines 56. Thus the valves 50 provide for a substantially higher flow rate from the cylinder 20 to the reservoir 24 and a corresponding rapid retraction of the piston rod 18 and ram 16 to minimize the cycle time for splitting a log. This significant reduction in the cycle time is especially important when splitting a large number of logs since a log cannot be placed on the frame 10 until after the ram 16 is fully retracted.

From the drawing in the above description, it is apparent that a log splitter incorporating a control system constructed in accordance with the invention, provides desirable features and advantages. Primarily, the control system of the invention provides for using a lower cost single-acting hydraulic cylinder 20 while also providing for rapid return of the piston rod and ram after a log has been split. The two relatively low cost control valves 50 coupled together to operate in unison or simultaneously provide not only for withstanding the high pressure fluid but also for dual flow paths for returning hydraulic fluid from the cylinder 20 to the reservoir 24.

While the form of log splitter or apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. In a log splitter including a frame having opposite end portions, a first log splitting member secured to one said end portion of said frame, a hydraulic cylinder secured to the other said end portion of said frame and having an extendable piston rod, a second log splitting member connected to said piston rod, said piston rod and said second log splitting member being movable between a retracted position and an extended position relative to said first log splitting member in response to the flow of hydraulic fluid within said hydraulic cylinder for splitting a log positioned between said first and second log splitting members, a power driven hydraulic pump and a hydraulic reservoir supported by said frame, and a control system for supplying hydraulic fluid from said reservoir to said hydraulic cylinder through said pump and for returning the fluid from said hydraulic cylinder and said pump to said reservoir, the improvement wherein said control system comprises a pair of hydraulic control valves each having a movable valve control member, a plurality of fluid lines connecting said hydraulic cylinder to said control valves, fluid conduit means connecting said control valves to said reservoir, and actuating means connected to said control members for moving both of said valve control members generally simultaneously to provide for a rapid return of hydraulic fluid from said hydraulic cylinder to said reservoir and corresponding rapid movement of said piston rod and said second log splitting member to said retracted position and thereby provide for quickly and efficiently splitting a supply of logs.

2. A log splitter as defined in claim 1 wherein said pair of hydraulic control valves are coupled together with said control members movable in the same direction.

3. A log splitter as defined in claim 2 wherein said control members of said valves include parallel spaced threaded rods, a plate connecting said threaded rods, and a plurality of nuts for adjusting said plate axially on said threaded rods.

4. A log splitter as defined in claim 2 wherein said pair of control valves are substantially identical and have corresponding mounting holes, and a set of tie bolts extending through said holes for coupling said valves together.

5. A log splitter as defined in claim 1 wherein said control system includes a manifold connecting to one of said fluid lines, conduit means connecting said manifold to said pump and said reservoir, and a pressure responsive relief valve within said conduit means for determining the maximum fluid pressure within said cylinder.

6. A log splitter as defined in claim 1 wherein said actuating means comprise a control member for opening said control valves in response to movement of said second log splitting member to said extended position.

7. In a log splitter including a frame having opposite first and second end portions, a first log splitting member secured to said first end portion of said frame, a hydraulic cylinder secured to said second end portion of said frame and having an extendable piston rod, a second log splitting member connected to said piston rod, said piston rod and said second log splitting member being movable between a retracted position and an extended position relative to said first log splitting member in response to the flow of hydraulic fluid within said hydraulic cylinder for splitting a log positioned between said first and second log splitting members, a set of wheels supporting said second end portion of said frame, a power driven hydraulic pump and a hydraulic reservoir connected to said second end portion of said frame, and a control system for supplying hydraulic fluid from said reservoir to said hydraulic cylinder through said pump and for returning the fluid from said hydraulic cylinder and said pump to said reservoir, the improvement wherein said control system comprises a pair of hydraulic control valves each having a linear movable valve control member, means connecting said control valves together with said control members movable on parallel spaced axes, a plurality of fluid lines connecting said hydraulic cylinder to said control valves, fluid conduit means connecting said control valves to said reservoir, and actuating means for moving both of said valve control members in unison to provide for a rapid return of hydraulic fluid from said hydraulic cylinder to said reservoir and corresponding rapid movement of said piston rod and said second log splitting member to said retracted position and thereby provide for quickly and efficiently splitting a supply of logs.

8. A log splitter as defined in claim 7 wherein said actuating means comprise a control member for opening said control valves in response to movement of said second log splitting member to said extended position.

* * * * *